US007227316B2

(12) United States Patent
Lu

(10) Patent No.: US 7,227,316 B2
(45) Date of Patent: Jun. 5, 2007

(54) PROTECTIVE AND MEASURE DEVICE FOR MULTIPLE COLD CATHODE FLUORESCENT LAMPS

(76) Inventor: Chao-Cheng Lu, 4-4, Alley 27, Lane 143, Chun Kung Road, Taipei (TW) 11614

( * ) Notice: Subject to any disclaimer, the term of this patent is extended or adjusted under 35 U.S.C. 154(b) by 779 days.

(21) Appl. No.: 10/727,848

(22) Filed: Dec. 2, 2003

(65) Prior Publication Data

US 2006/0181227 A1 Aug. 17, 2006

(30) Foreign Application Priority Data

Jul. 7, 2003 (TW) ..... 92118475 A

(51) Int. Cl.
*H05B 37/02* (2006.01)

(52) U.S. Cl. ..... 315/308; 315/255; 315/277; 315/360

(58) Field of Classification Search ..... 315/246, 315/254, 255, 265, 276, 277, 283, 287, 291, 315/308, 360
See application file for complete search history.

(56) References Cited

U.S. PATENT DOCUMENTS

| | | | | |
|---|---|---|---|---|
| 5,097,181 | A * | 3/1992 | Kakitani | 315/209 R |
| 5,309,155 | A * | 5/1994 | Hsien et al. | 340/907 |
| 5,886,477 | A * | 3/1999 | Honbo et al. | 315/209 PZ |
| 6,396,722 | B2 * | 5/2002 | Lin | 363/98 |
| 7,015,652 | B2 * | 3/2006 | Shi | 315/224 |
| 2004/0004450 | A1 * | 1/2004 | Hsu et al. | 315/291 |

* cited by examiner

*Primary Examiner*—Douglas W. Owens
*Assistant Examiner*—Jimmy Vu
(74) *Attorney, Agent, or Firm*—Jacobson Holman PLLC

(57) ABSTRACT

A protective and measure device for multiple cold cathode fluorescent lamps includes an electronic ballast functioning as a high-frequency power source for driving multiple cold cathode fluorescent lamps (CCFLs), primarily by parallel connecting one end of each of a plurality of CCFL to a measure element to measure the LED power source provided by the measure element's photocoupler, and concurrently serially connect the photocoupler's collect-emitter terminal, followed by employing comparators to assess the open circuit, over current, and under current among multiple cold cathode fluorescent lamps. Said electronic ballast serves to protect CCFLs, and thus contribute to the quality and protection required for large LCD monitors.

40 Claims, 8 Drawing Sheets

PROTECTIVE AND MEASURE DEVICE FOR MULTIPLE COLD CATHODE FLUORESCENT LAMPS

BACKGROUND OF THE INVENTION

1. Field of the Invention

The present invention is used in the field of the backlighted display of large- or super-size LCD monitors, which requires parallel connection of multiple cold cathode fluorescent lamps (CCFLs) as light source. The high-frequency power source is typically supplied by an electronic ballast or power exchanger to ensure multiple cold cathode fluorescent lamps of single task working frequency, circuit stability, brightness efficiency, high quality and low distortion. The present invention provides measuring to such ends and serves as a protective device.

2. Description of the Prior Art

Typical application of CCFL as the backlighted display of LCD monitors requires an inverter and one or two CCFLs. When employed on large LCD monitors or large LCD TV screens, five to ten inverters may be required that will ensue the following drawbacks:

1. In case one of the tens of CCFLs is defective, the fault cannot be effectively detected, resulting in affecting LCD monitor quality;
2. As variations in high frequency exist among the inverters producing multiple frequency interferences to the LCD monitor, it increases the cost to introduce electromagnetic interference purging;
3. As multiple inverters' high-frequency voltage outputs will invariably vary, the brightness of CCFLs will be inconsistent, thus affecting the LCD monitor quality;
4. Cost of employing multiple inverters is higher than single electronic ballast or a single inverter.

Thus, addressing foregoing deficiencies of typical application of CCFL as the backlighted display of LCD monitors, an innovative solution is proposed. A type of device functioning to measure and protect the circuits of CCFLs is designed so that when any one of tens of CCFLs fails, said device can effectively detect the defect to maintain the LCD monitor quality, while concurrently solving the typical multi-inverter practice's drawbacks of frequency interference, structural complexity and unnecessary high cost. These problems have long awaited for solutions by users and the inventor alike. After years of electronics related studies together with field research and development experience, aspiration arises to come up with an efficient solution. After repeated designing, investigating, model making and improving, a superior type of electronic device for measuring and protecting the circuits of CCFL has been designed specifically to address said problems.

SUMMARY OF THE INVENTION

To effectively provide for the backlighted display required in large- or super-size LCD monitors:

An object of the present invention is to provide a device for measuring and protecting CCFLs to solve the deficiencies of typical multiple-inverter application.

Another object of the present invention is to employ electronic ballast as a single high-frequency power source to solve typical multiple-inverter application's deficiencies of frequency interference and high cost.

A further object of the present invention is to provide for the backlighted display required in large- or super-size LCD monitors, LCD TV screens, and LCD advertising mediums.

Still another object of the present invention is to present superior hardware circuits to prove capability of attaining the claimed purposes and efficacy, and as the basis for relevant applications.

To solve the deficiencies of typical multiple-inverter employment on large LCD monitors, the present invention includes the following features:

1. The measure element parallel connected to each CCFL of a plurality of CCFLs (hereinafter called "CCFL Cluster"), pending on the CCFL's characteristics and requirements may employ a single high-voltage (HV) precision resistor, or a plurality of diodes, or Zener diode.
2. The photocoupler pending upon requirement may be a general photocoupler or photothyristor coupler; the primary is LED, the secondary transistor or thyristor. The power source of the primary is supplied by the voltage of the two ends of the measure element parallel connected to a single CCFL and through limit current resistor, characterised by each CCFL's secondary being serially coupled.
3. To boost the photocoupler's primary sensitivity, pending upon requirement may employ full-wave rectifier circuit or digital comparator integrated circuit (DCIC), subjecting the AC positive terminal and the AC negative terminal passing through limit current resistor to connect to photocoupler's primary.
4. Because of the photocoupler, CCFL is isolated from the up, down limit comparators, or differential amplifier integrated circuit (DAIC), or DCIC, so prevented from mutual interfering; the requirement of isolation voltage may be met with choice of photocoupler.
5. The up, down limit comparators, or ACIC, or DCIC on the protect circuit can function to initiate "on", "off" of CCFL Cluster, and over current triggered by HF power source's voltage surge, and comparison of settings of under current triggered by under HF voltage, to attain the object of protecting and enhancing light source quality.
6. The time delay circuit has the characteristic that, when the electronic ballast is functioning stably and that the CCFL Cluster is fully and stably on, the time required for the up, down limit comparators, or ACIC, or DCIC to output to the HF power circuit's initiate thyristor to determine the on/off state of HF power circuit; the time delay circuit's time delay initiate time is determined by the CCFL Cluster's number, characteristic and quality.
7. Power input of the power supply may be from HF power circuit's AC power or HF power circuit's HF oscillator circuit; the output AC power source is supplied to the protect circuit and the time delay circuit.
8. HF power circuit employs full- or half-bridge type electronic ballast equipped with single HF power source, sufficient HF output function, single output voltage, brightness control, working frequency adjustment, start control and protection against irregularities.

DETAILED DESCRIPTION OF THE PREFERRED EMBODIMENT

Figure 1:
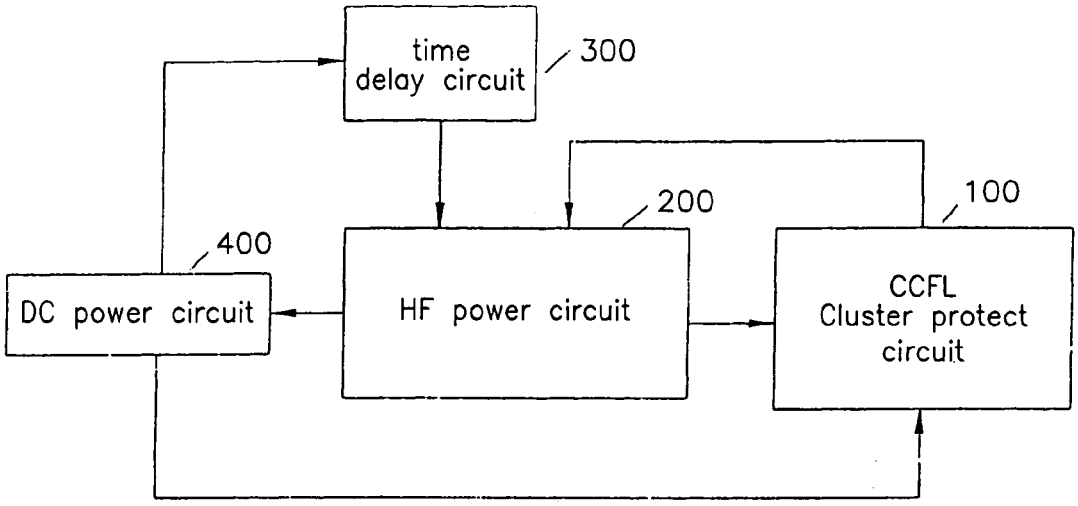
FIG. 1 is a block chart of the present invention.

As shown in FIG. 1, the block chart of the claimed device consists of: CCFL Cluster protect circuit 100, HF power circuit 200, time delay circuit 300, and DC power circuit 400.

Figure 2:
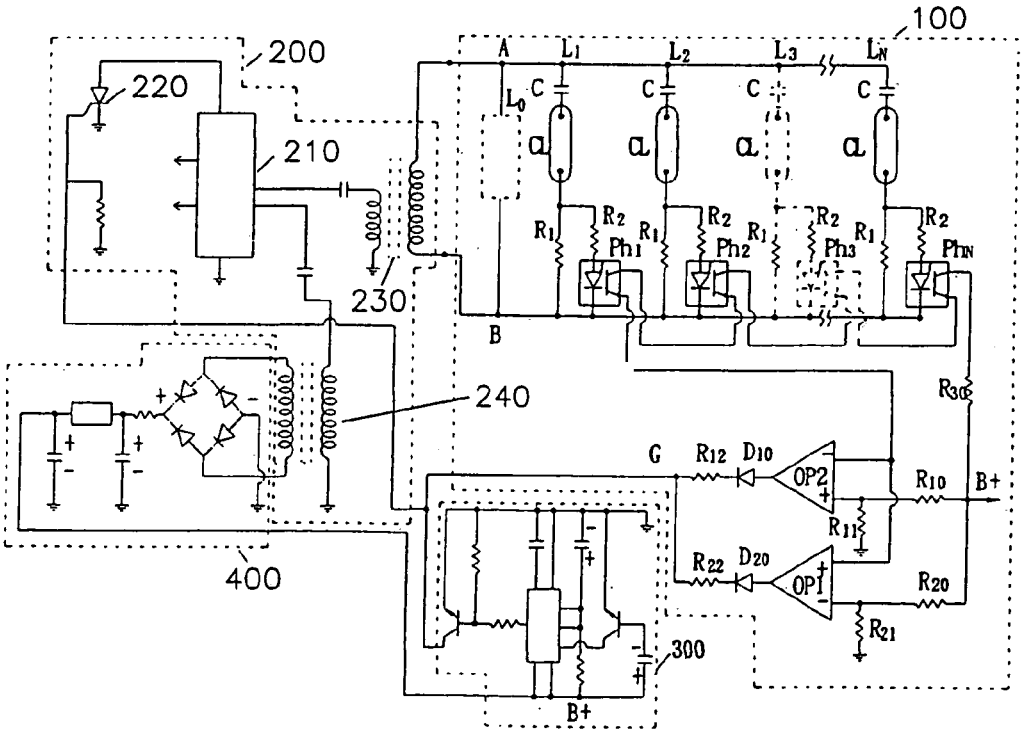
FIG. 2 is a circuit diagram of a preferred embodiment of the present invention.

FIG. 2 shows a preferred embodiment of the present invention. HF power circuit 200 is a type of electronic ballast driven by AC power, primarily structured on regular half- or full-bridge type oscillator circuit. The HF oscillator voltage passes through the primary coil of HF transformer, while the secondary coil detects a high voltage (HV) at AB terminal, connected with L1, L2, L3 . . . Ln cold cathode fluorescent lamps (collectively called "CCFL Cluster"), wherein Lo represents another CCFL Cluster and protect circuit, thus the circuit consists of two clusters. To meet with the requirement of backlighting super-size LCD screens, multiple clusters may be conjoined. Additionally, a HF oscillator voltage passes the primary coil of HF transformer, while the secondary coil detects the input terminal of a low voltage (LV) supply to DC power circuit 400, and the output DC voltage supplies to CCFL Clusters and protect circuit 100 up, down limit comparators OP1 and OP2 (or DAIC or DCIC), an time delay circuit 300, or power supply by other independent system. HF oscillator circuit 210 is controlled by thyristor silicon control rectifier (SCR) so that when the output of up, down limit comparators OP1 and OP2 is positive, thyristor SCR 220 will be triggered, HF oscillator circuit 210 will stop oscillation; at this time CCFL Clusters have no HF power source, and the backlighting function ceases.

Figure 3:
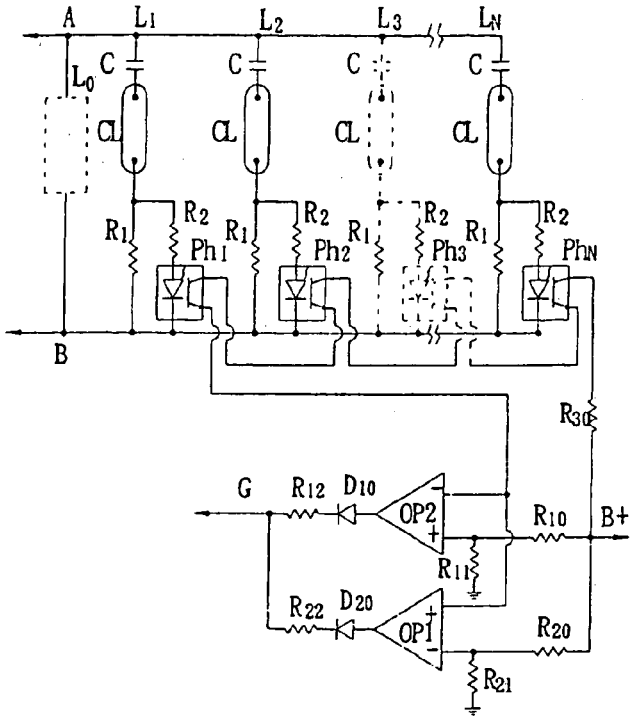
FIG. 3 is a circuit diagram of a first embodiment of the CCFL measure and protective device according to the present invention.

FIG. 3 is a first embodiment of the CCFL measure and protective device according to the present invention. From the circuit diagram, it is evident that the AB terminal is connected with L1, L2, L3 . . . Ln cold cathode fluorescent lamps, wherein L1, L2, L3 and Ln are of the same circuit. L1 consists of HF HV Capacitor C, cold cathode fluorescent lamp CL, measure resistor R1, limit current resistor R2 and primary of photocoupler. HF HV Capacitor C functions to stabilise HF CCFL flashing; measure resistor R1 adopts HV resistor; the cold cathode fluorescent lamp CL current passes the measure resistor R1 to derive a voltage attenuation; the voltage attenuation's voltage passes through the limit current resistor R2 to the primary of photocoupler Ph1, namely the photocoupler LED terminal, characterised by serial connection of HV Capacitor C and cold cathode fluorescent lamp CL and measure resistor R1; the two terminals are coupled with HF HV terminal, namely AB terminal, and the two ends of measure resistor R1 are parallel connected to the two ends of the LED terminal of photocoupler Ph1 after serial connection.

When photocoupler Ph1, Ph2, Ph3 . . . Phn LED receives power supply, the secondary, namely collect-emitter's two ends will be in 'Turn-on' state; the two ends of photocoupler Ph1, Ph2, Ph3 . . . Phn collect-emitter form serial connection, thus DC power source terminal B+ passes through limit current resistor R30, then passes through collect-emitter serial circuit of photocoupler Ph1, Ph2, Ph3 . . . Phn to reach the up comparator OP1 noninverter terminal and the down comparator OP2 inverter terminal. In this case when comparator OP1 noninverter terminal's voltage is higher than the inverter terminal's set voltage, it indicates that the CCFL Clusters are subjected to overly HF voltage that mitigates the resistance at the collect-emitter of photocoupler Ph1, Ph2, Ph3 . . . Phn, namely causing the measure resistor R1 to have excessive HF current triggered by HF voltage to drive up voltage at the two ends of measure resistor R1, resulting in resistance reduction between collect-emitters, which leads to the up comparator OP1 noninverter's voltage being higher than the inverter. The output end sends out a positive voltage passing through the diode D20, and the limit current resistor R22 to the thyristor SCR220 of the electronic ballast 200 to conduct SCR220: the HF oscillator circuit 210 stops functioning, AB two terminals drained of HF and HV to protect the CCFL Clusters. In the case HF and HV are insufficient at the AB terminal, or one of the CCFL Clusters is "on" or spark occurrence at the two ends of the CCFL Clusters due to poor contact, it will lead to driving up the photocoupler's collect-emitter resistance, and the sparks produced will cause unstable collect-emitter "on" and "off". The positive terminal voltage of the down comparator OP2 is greater than the negative terminal, causing the output terminal to send out a voltage, passing the diode D10, then passing the limit current resistor R12 to reach the thyristor SCR220 of the electronic ballast 200. Thus purging the AB two terminals of HF and HV to protect the CCFL Clusters' function and quality. In this preferred embodiment, the up, down limit comparators may be replaced with DCIC or ACIC.

Figure 4:
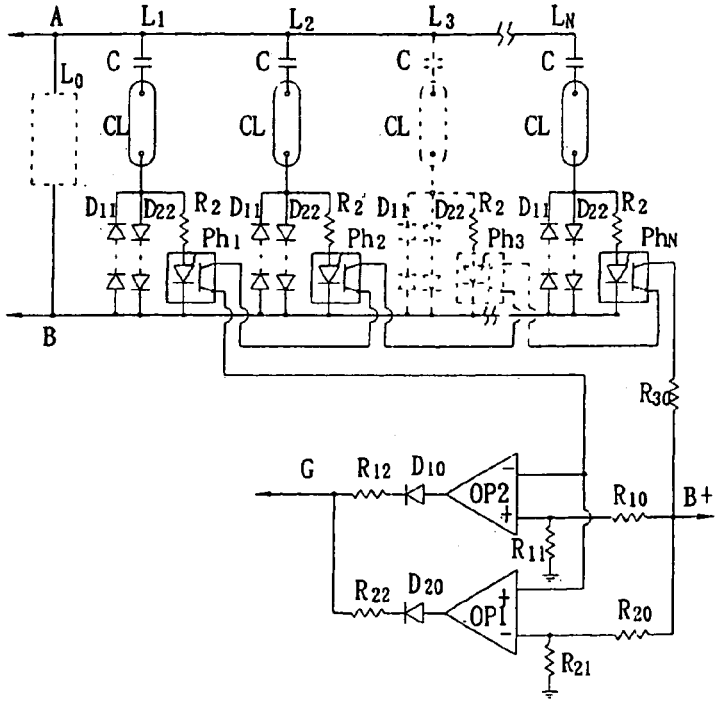
FIG. 4 is a circuit diagram of a second embodiment of the CCFL measure and protective device according to the present invention.

In a second embodiment of the present invention as shown in FIG. 4, the measure resistor R1 in the diagram of FIG. 3 is changed to first diode cluster D11 and second diode cluster D22; the remainder of the schematic and functioning principle stays. The second diode cluster D22 consists of multiple diodes, characterised by diodes' positive voltage of about 0.7 volt, i.e., serial connection of five diodes arrives at 0.7 volt×5=3.5 volts, using this voltage to supply the limit current resistor R2 and the LED terminal of the photocoupler Ph1, meanwhile the first diode cluster D11 is intended to balance the voltage drop of HF voltage during the positive and negative half cycles. The purpose of the circuit is to accommodate the heavy load of the CCFL CL, in which the first and second diode clusters are disposed at the reverse direction. In this preferred embodiment, the up and down limit comparators may be replaced by DAIC or DCIC.

Figure 5:
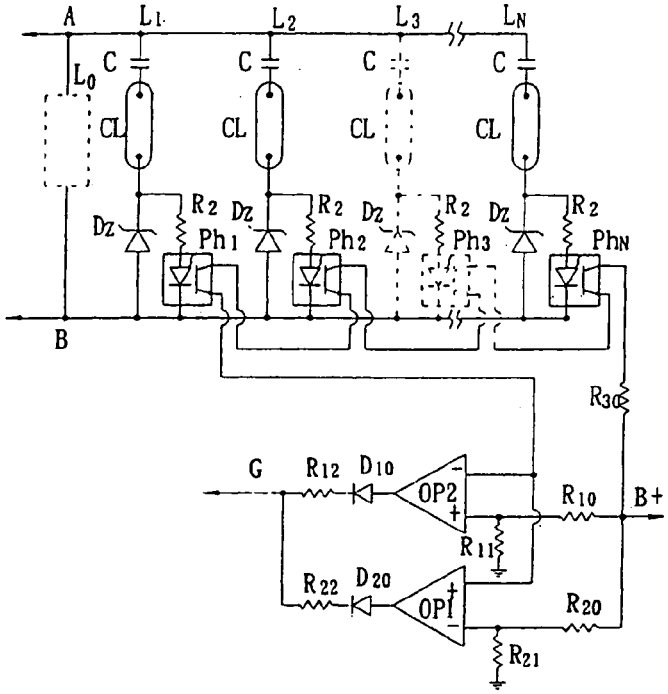
FIG. 5 is a circuit diagram of a third embodiment of the CCFL measure and protective device according to the present invention.

In a third embodiment as shown in FIG. 5, the measure resistor R1 of FIG. 3 is changed to Zener diode Dz; the remainder of the schematic and functioning principle stays. The Zener voltage at the two ends of Zener diode Dz is for supplying the limit current resistor R2 and the LED terminal of the photocoupler Ph1, intended to accommodate small CCFL CL, characterised by simplicity in structure and low in cost. In this preferred embodiment, the up and down limit comparators may be replaced by DAIC or DCIC.

Figure 6:
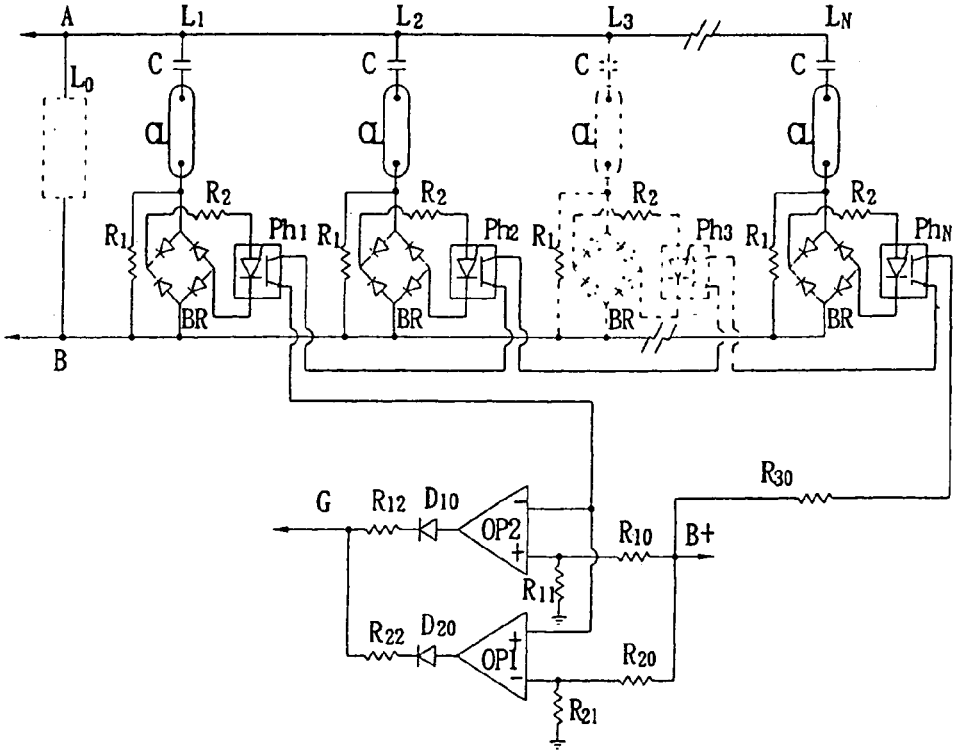
FIG. 6 is a circuit diagram of a fourth embodiment of the CCFL measure and protective device.

In a fourth embodiment as shown in FIG. 6, to enhance the sensibility of the photocouplers Ph1, Ph2, Ph3 . . . Phn, the two ends of the measure resistor R1 in the diagram of FIG. 3 are parallel connected to form the AC terminal of a bridge rectifier BR. The DC positive terminal is coupled with the limit current resistor R2 and the LED terminal of the photocoupler Ph1, then connected the DC negative terminal. The power supplying the LED terminal still comes from the two ends of the measure resistor R1, intended to supply full wave voltage at the LED terminal of the photocouplers Ph1, Ph2, Ph3 . . . Phn to boost the sensibility, characterised by serving as suitable backlighting for small CCFL CL or few numbers of CCFLs. In this preferred embodiment, the up and down limit comparators may be replaced by DAIC or DCIC.

Figure 7:
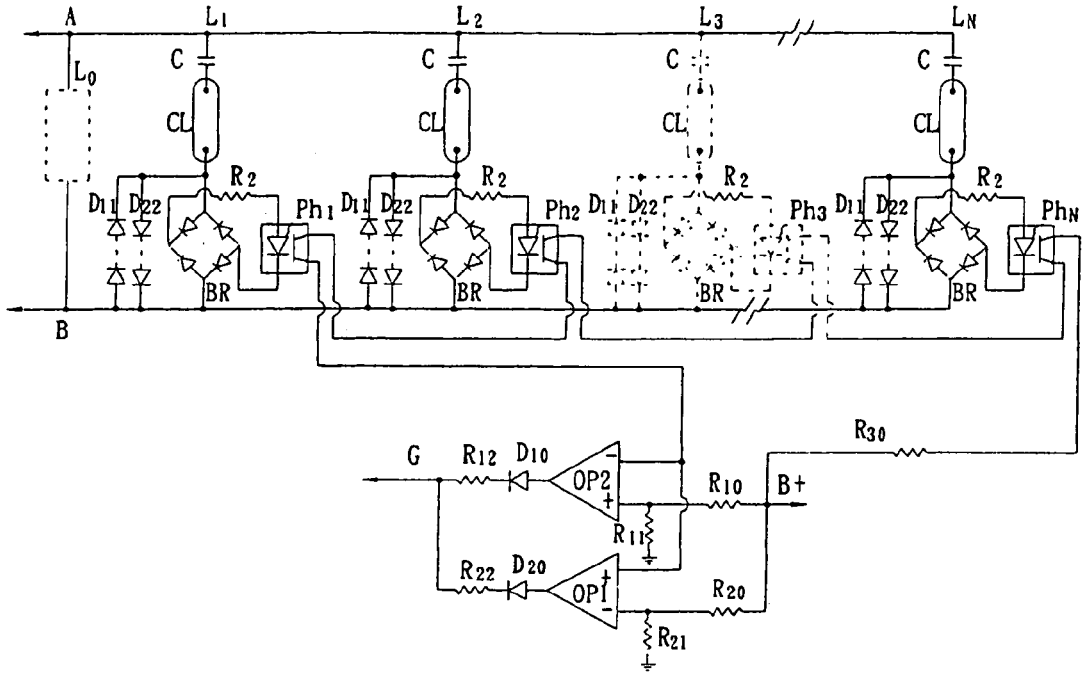
FIG. 7 is a circuit diagram of a fifth embodiment of the CCFL measure and protective device according to the present invention.

In a fifth embodiment as shown in FIG. 7, the measure resistor R1 from diagram of FIG. 6 is changed to the first and second diode clusters D11 and D22, same as FIG. 4, the functioning principle is the same as FIG. 4 and FIG. 6, intended for supplying large CCFL and photothyristor, characterised by suitability to photothyristor of lower sensibility. For backlighting super-size LCD screens, photocoupler may be adopted. In this preferred embodiment, the up and down limit comparators may be replaced by DAIC or DCIC.

Figure 8:
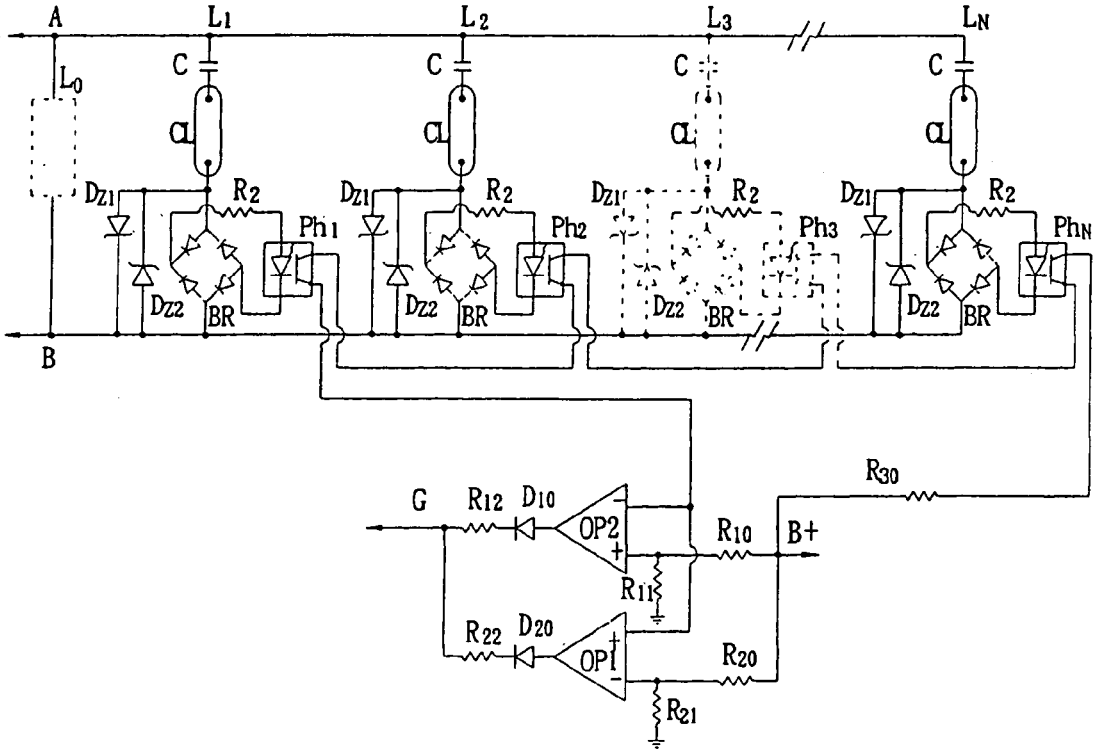
FIG. 8 is a circuit diagram of a sixth embodiment of the CCFL measure and protective device according to the present invention.

In a sixth embodiment as shown in FIG. 8, the measure resistor R1 of FIG. 6 is changed to the first and second Zener diode Dz1 and Dz2, the functioning principle is the same as FIG. 6. The voltage for the LED terminal of the photocouplers Ph1, Ph2, Ph3 . . . Phn comes from the Zener voltage of the first and second Zener diode Dz1 and Dz2, intended for backlighting small CCFL cluster, characterised by simplicity in structure, low in cost, and boosted photocoupler sensibility. In this preferred embodiment, the up and down limit comparators may be replaced by DAIC or DCIC.

Figure 9:
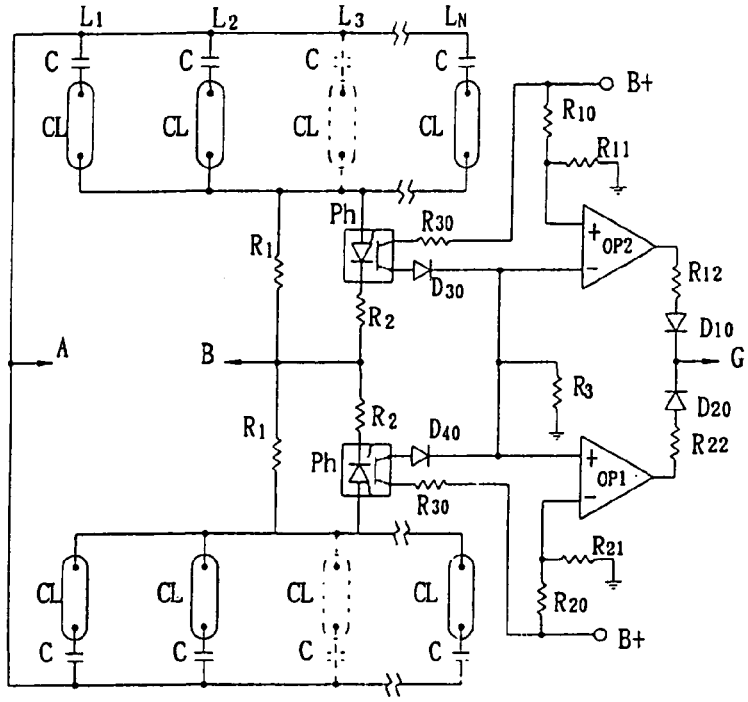
FIG. 9 is a circuit diagram of a seventh embodiment of the CCFL measure and protective device according to the present invention.

In a seventh embodiment as shown in FIG. 9, two CCFL clusters share a set of up and down comparators OP1 AND OP2. Among each cluster, one end of every CCFL is coupled together to jointly use a measure resistor R1. The limit current resistor R2, after serially connected to the LED terminal of photocoupler Ph is joined at the two ends of the measure resistor R1. The collect-emitter end of the photocoupler Ph is connected with diodes D30 and D40, while the N-type terminal of D30 and D40 and grounding resistor R3 are coupled to the noninverter and inverter of the up and down comparators OP1 and OP2, the functioning principle is the same as diagram of FIG. 3. In place of the measure resistor R2, two diode clusters D11 and D22, or Zener diode Dz or Zener diodes Dz1 and Dz2 may be used as replacement pending upon requirement. It is characterised by the purpose of reducing the number of photocouplers and up, down comparators. In this preferred embodiment, the up and down limit comparators may be replaced by DAIC or DCIC.

Figure 10:
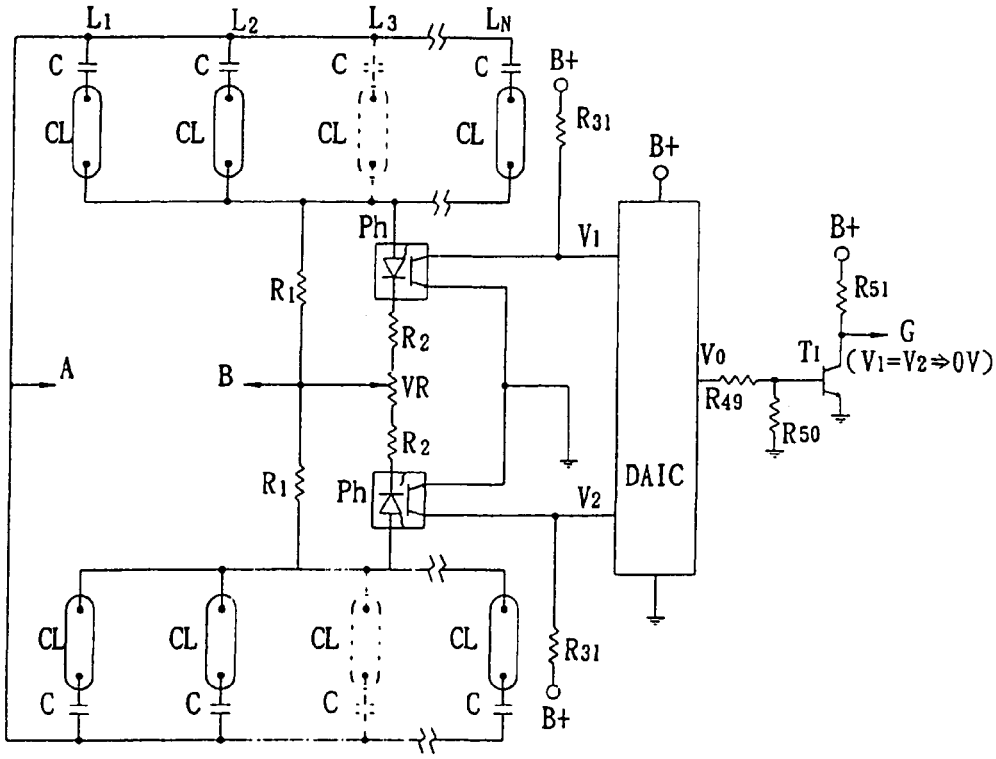
FIG. 10 is a circuit diagram of an eighth embodiment of the CCFL measure and protective device according to the present invention.

In an eighth embodiment as shown in FIG. 10, two CCFL clusters share the DAIC of a differential amplifier. Among each CCFL cluster, one end of every CCFL is coupled together to jointly use a measure resistor R1. The limit current resistor R2, after serially connected to the LED terminal of photocoupler Ph is joined at the two ends of the measure resistor R1. The mid point of veritable resistor VR and one end of the measure resistor R1 are jointly connected to B terminal. The emitter terminal of the photocoupler Ph is grounded, while the collect-emitter terminal is coupled with the V1 terminal of DAIC and one end of the negative resistor R31, and the other end of negative resistor R31 is connected to B+ power source. The V2 terminal of the DAIC is connected another CCFL cluster, so that when V1=V2, the output voltage V0 is positive, and concomitantly when the DAIC is V1=V2, the output voltage is V0 is zero, pending upon the application without restriction. In this diagram, when the DAIC is V1=V2, the output voltage V0 is positive. During the initial use of the two CCFL clusters, the two CCFL clusters may be adjusted by balance resistor VR, for V1 and V2 to derive equivalent voltage. After using for a while when V1 and V2 become unequal, the output voltage of the V0 is zero, indicating one or multiple lamps of the CCFL cluster deteriorated, closed circuited or shorted, to trigger the protect circuit in achieving the purpose of protection. The V0 output terminal of the DAIC is connected to fork resistors R49 and R50 to reach the base terminal of the transistor T1, while the collector terminal is coupled with a negative resistor R51 as the output terminal, which is then connected to G terminal. The voltage output at the terminal G is opposite to the output voltage of the V0. When V0 is positive and the G terminal is zero (about 0.4 v) and V0 is zero, the output of the G terminal is positive. The other end of the negative resistor R51 is connected to B+ power source. The preferred embodiment is characterised by when two CCFL clusters are uneven in number, or the lamp properties are not uniform, it requires only initial tuning of the balance resistor VR for the two lamp clusters to reach voltage equilibrium before application to achieve the purpose of protection. In this preferred embodiment, the DAIC may be replaced with up and down limit comparators.

Figure 11:
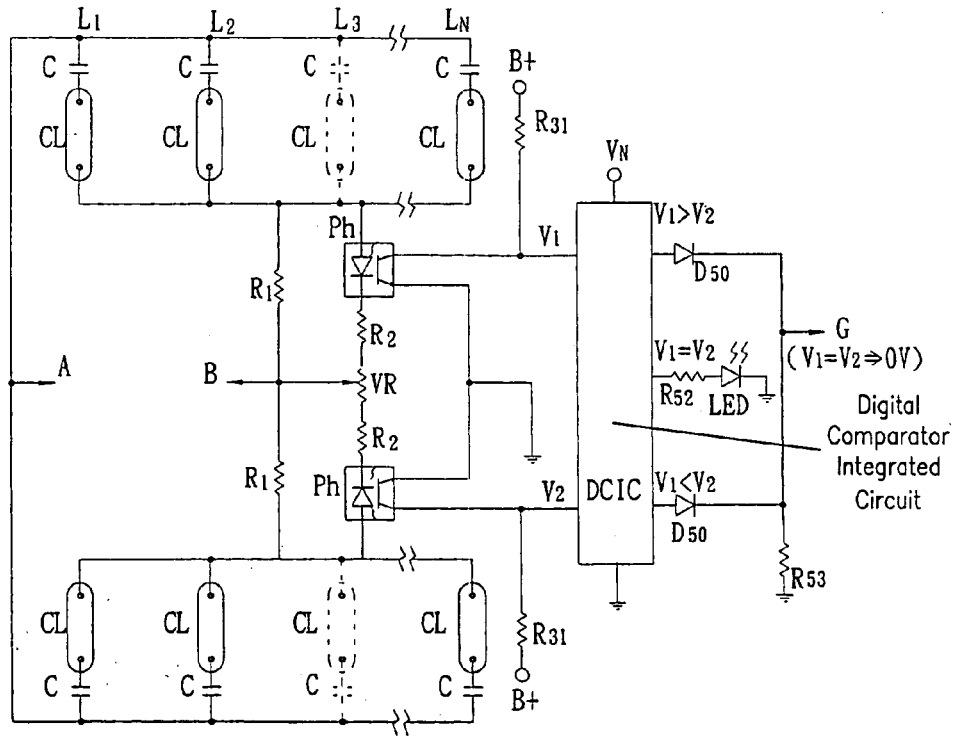
FIG. 11 is a circuit diagram of a ninth embodiment of the CCFL measure and protective device according to the present invention.

In a ninth embodiment as shown in FIG. 11, DCIC is used to replace the DAIC of FIG. 10. The conditions of input terminals V1 and V2 are exactly the same, while the output end comprises three sets: V1>V2, V1=V2, and V1<V2. When V1=V2, its output terminal is positive, passing through a limit current resistor R52 before connecting to the P-type terminal of LED, while the N-type terminal of LED is grounded. At this time the LED is on, while the output voltage terminal of V1>V2 and V1<V2, namely the electrical potential of G terminal is zero. Both V1>V2 and V1<V2 terminals are serially connected with unilateral diode D50 to G terminal. When V1≠V2, G terminal can receive a positive output, and is further coupled with a grounding resistor R53, functioning to keep G terminal at zero potential. The preferred embodiment is characterised by an additional set of V1=V2 equilibrium indicator and an additional DCIC, and the power supply voltage Vn to the DCIC is contingent upon the choice of IC variety without limitation. In this preferred embodiment, the DCIC may be replaced with up and down limit comparators.

Figure 12:
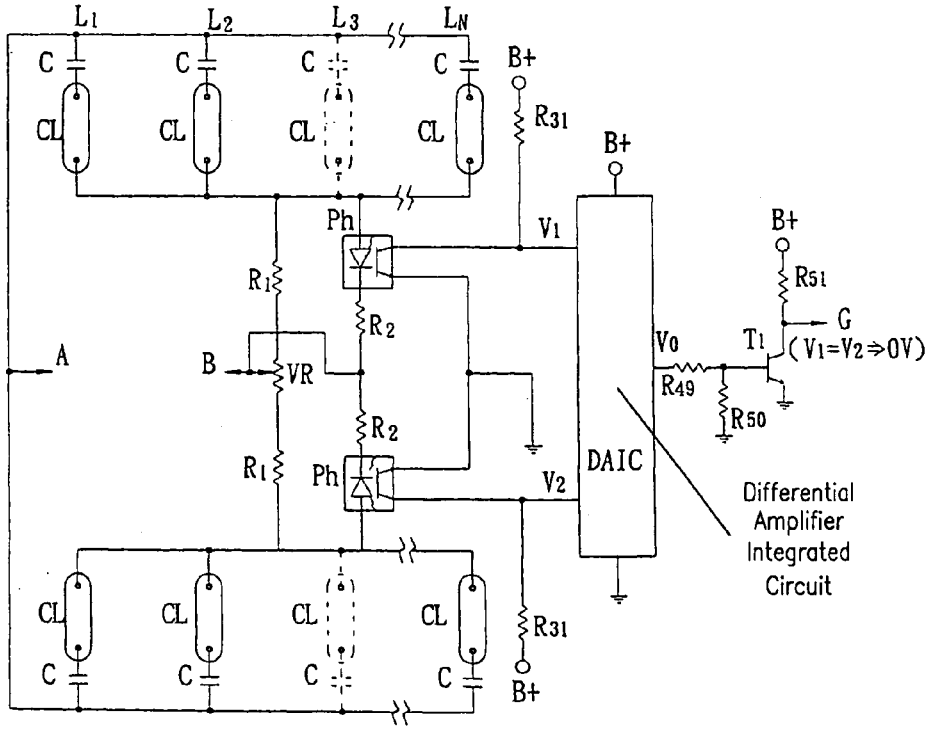
FIG. 12 is a circuit diagram of the eighth embodiment according to the present invention showing an alternative connection method for the balance resistor VR.

As shown in FIG. 12, the balance resistor VR capable of equilibrium tuning applied in the eighth embodiment is allocated from the limit current resistor R2 to connect to the circuit of the measure resistor R1, characterised by that the two ends of the variable resistor VR are connected to the measure resistor R1, and the mid point to B point, and concurrently the mid point of the two limit current resistors R2 is also connected to B point. The function is suited for CCFL clusters of small consumption. In this preferred embodiment, the DAIC may be replaced with up and down limit comparators.

Figure 13:
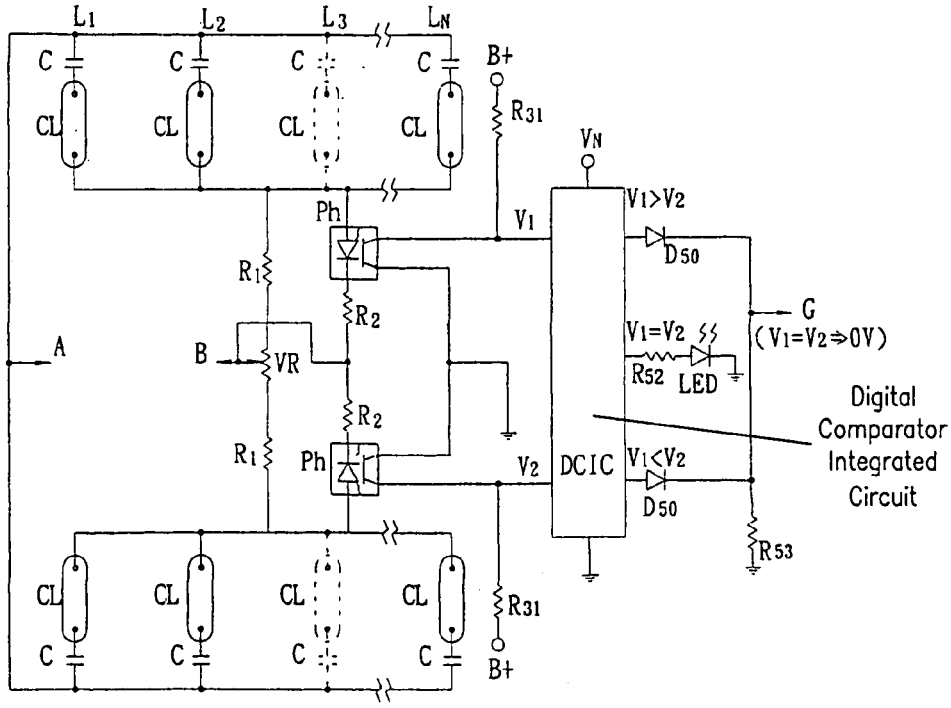
FIG. 13 is a circuit diagram of the ninth embodiment according to the present invention showing an alternative connection method for the balance resistor VR.

As shown in FIG. 13, the balance resistor VR capable of equilibrium tuning applied in the ninth embodiment is allocated from the limit current resistor R1 to connect to the circuit of the measure resistor R2, characterised by that the two ends of the variable resistor VR are connected to the measure resistor R1, and the mid point to B point, and concurrently the mid point of the two limit current resistors R2 is also connected to B point. The function is suited for CCFL clusters of small consumption. In this preferred embodiment, the DAIC may be replaced with up and down limit comparators.

Figure 14:
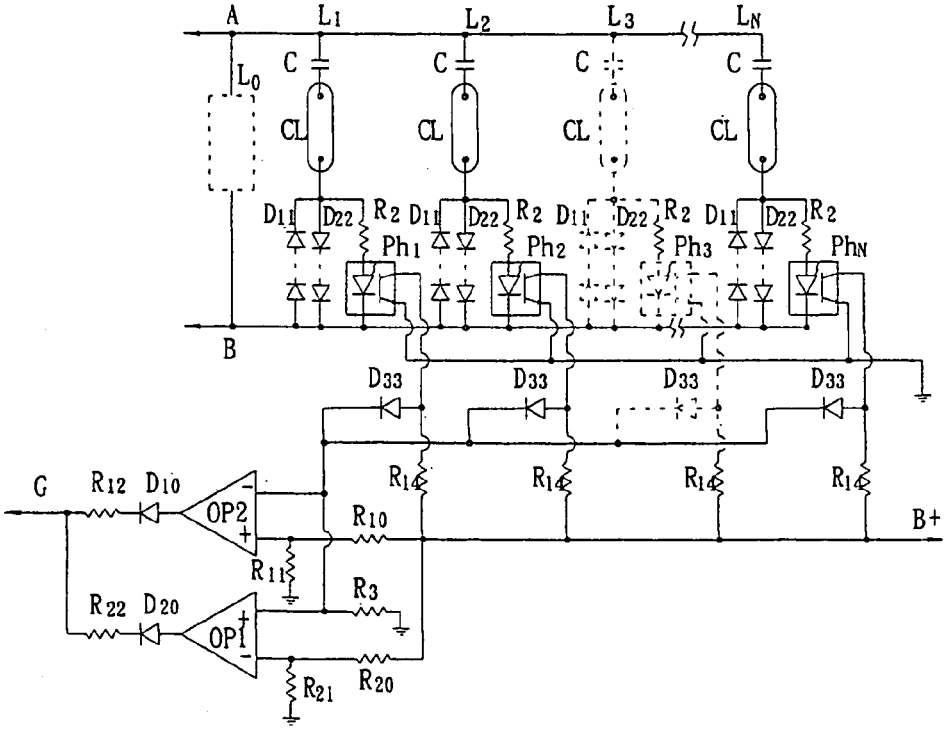
FIG. 14 is a circuit diagram of the tenth embodiment of the CCFL measure and protective device according to the present invention.

In a tenth embodiment as shown in FIG. 14, the serial connection of the secondary of the photocouplers Ph1, Ph2, Ph3 . . . Phn is altered to independent photocoupler circuits. The diagram of FIG. 14 shows that each photocoupler Ph1, Ph2, Ph3 . . . Phn has a negative resistor R14 and unilateral output diode D33. One end of the negative resistor R14 is connected directly to power source B+, the other end to the collect-emitter terminal of the photocoupler secondary and the P-type terminal of unilateral diode D33. The emitter terminal of the photocoupler secondary is connected to the negative terminal of the DC power, while the N-type terminal of the unilateral diode D33 is conjoined with all the N-type terminals of unilateral diode 33 of all photocouplers Ph1, Ph2, Ph3 . . . Phn, and further connected to the noninverter terminal of the up limit comparator OP1 and the inverter terminal of the down up limit comparator OP2. The functioning principle is that when CCFLs L1, L2, L3 . . . Ln on the AB terminal are functioning normally, the N-type terminal of the unilateral diode D33 has no output voltage; the noninverter terminal of the up limit comparator OP1 and the N-type terminal of the unilateral diode D33 are joined together as when the voltage at the noninverter terminal of the up limit comparator OP1 is zero, the output terminal G is zero voltage. If any CCFL of CCFL Cluster L1, L2, L3 . . . Ln open-circuits, the noninverter terminal of the up limit comparator OP1 will have a positive voltage, enabling the output terminal G to have a positive voltage that subject voltage to thyristor of SCR220 of the electronic ballast 200, resulting in eliminating HF voltage at the A and B terminals to achieve protection of CCFL quality.

Figure 15:
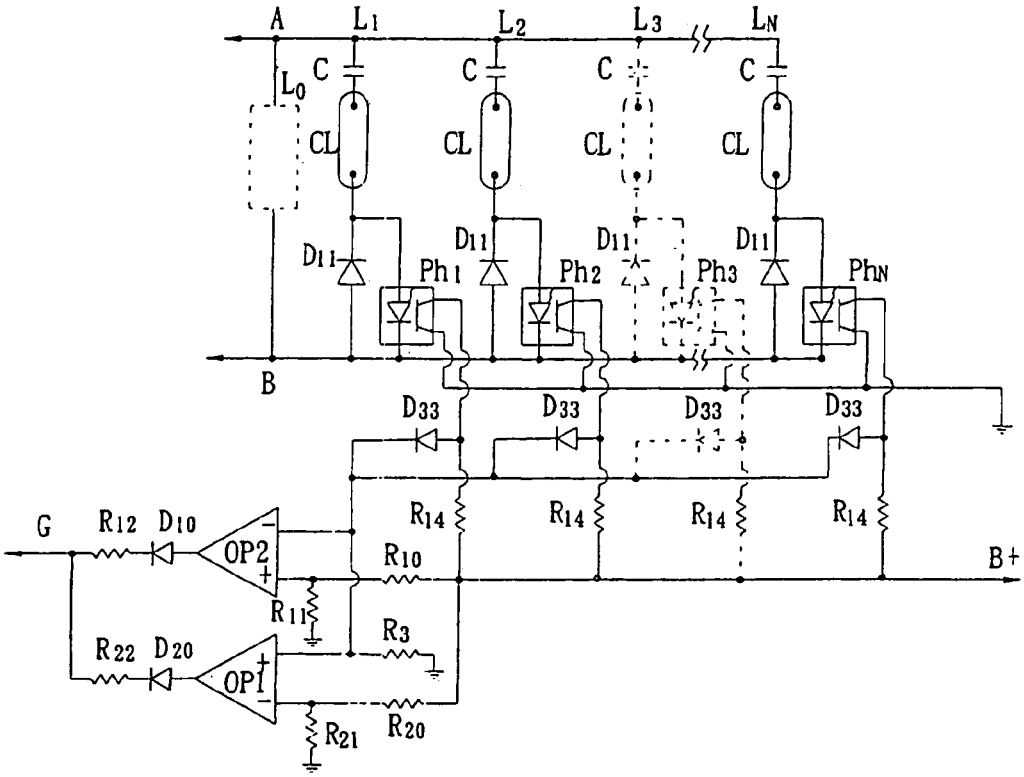
FIG. 15 is a circuit diagram of the eleventh embodiment of the CCFL measure and protective device according to the present invention.

In an eleventh embodiment as shown in FIG. 15, if the lamp current of CCFL Cluster L1, L2, L3 . . . Ln is smaller than the LED current of the photocouplers Ph1, Ph2, Ph3 . . . Phn, the LED of the photocouplers may be directly connected to the circuit, namely changing FIG. 14 diagram to the one presented in FIG. 15. The functioning principle of FIG. 15 is the same as FIG. 14, but simplified, provided the premises being that the current borne by photocoupler LED shall be greater than the CCFL current to deter burning photocoupler LED.

Figure 16:
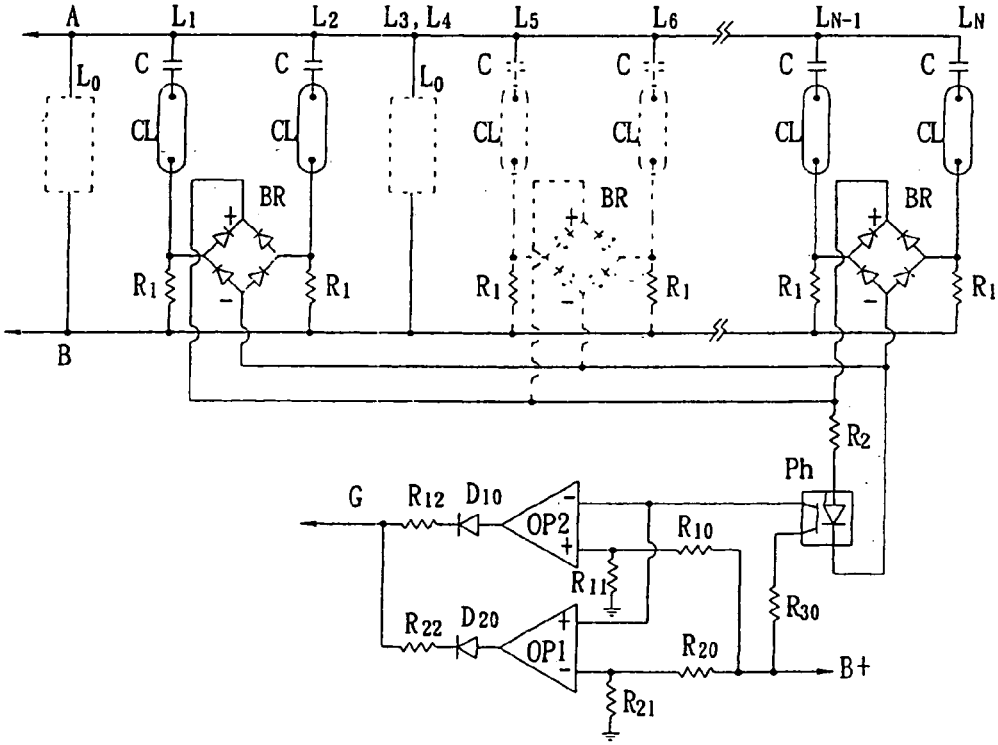
FIG. 16 is a circuit diagram of the twelfth embodiment of the CCFL measure and protective device according to the present invention.

In a twelfth embodiment as shown in FIG. 16, the schematic is a reconfiguration of FIG. 6 diagram's measure resistor R1 and bridge rectifier BR. The functioning principle lies with the two AC terminals of the bridge rectifier BR are connected to L1 and L2 measure resistor R1. When the lamp current of the two CCFL clusters L1 and L2 is the same, the positive and negative terminals of the bridge rectifier BR will be zero concurrently. If the current of the two CCFL clusters L1 and L2 is different, the potentials of the positive and negative terminals of the bridge rectifier BR will be different, ensuing a voltage. This voltage travels from the positive terminal through the limit current resistor R2 to reach the LED terminal of the photocoupler Ph. At this time, the secondary collect-emitter terminal of the photocoupler Ph is conducted, DC power BHF passing through the limit current resistor R30, then the collect-emitter of the photocoupler Ph to reach the positive terminal of the up limit comparator OP1 and the negative end of the down limit comparator OP2. At this time the output terminal G of the comparators has a positive current output to eliminate the HF voltage at AB terminal in achieving the goal of protecting CCFL cluster function and quality. The circuit is characterised by L1 and L2, L3, and L4, L5 and L6, . . . Ln–1 and Ln, every pair of CCFLs share a bridge rectifier BR, and all the positive terminals of the bridge rectifiers BR are connected together, and all the negative terminals of the bridge rectifiers BR are also connected together.

In summary, the preferred embodiment pertains to a type of device for measuring and protecting CCFL, mainly utilising a type of electronic ballast to serve as HF power source for the backlighting of multiple cold cathode fluorescent lamps by means of serial connect one end of each cold cathode fluorescent lamp of parallel connected CCFL Cluster with a measure element; said element provides power source for the photocoupler LED. Concurrently, the photocouplers' collect-emitter terminals are joined in serial connection, and then employ comparators to determine any short circuit, over current, or under current occurred within the CCFL Cluster, thus protecting the cold cathode fluorescent lamps to achieve large LCD monitors' quality requirement and performance protection.

The invention claimed is:

1. A measure device for cold cathode fluorescent lamps, said device comprises:

a high frequency power source circuit utilising AC power source;

a time delay circuit, wherein, when the electronic ballast is working stably, and the cold cathode fluorescent lamps are in full brightness and stable, there is a pause before determining the electronic ballast's "on", "off" status, the functioning time thus deferred is contingent upon the number, characteristic and quality of a CCFL Cluster;

a DC power source circuit, wherein the output terminal's DC voltage supplies the CCFL Cluster, the protect circuit, and the time delay circuit, or internal, external power supply from other independent system;

the CCFL Cluster formed by joining multiple CCFL sets through parallel connection, each of said CCFL set comprising HF HV capacitor, cold cathode fluorescent lamp, measure resistor, limit current resistor and photocoupler primary, wherein the HV capacitor, cold cathode fluorescent lamp and measure resistor are serially connected, two terminals of the CCFL set are connected to HF HV terminal, while two terminals of the measure resistor are coupled in parallel connection with two terminals formed by serial connection of the limit current resistor and photocoupler LED terminal; and A protection circuit, wherein the photocoupler's two collect-emitter terminals are formed in serial connection to couple with the up and down limit comparators, so that when the up and down limit comparators send out signals, HF power source is cut off.

2. The measure device according to claim 1, wherein the measure resistor of the CCFL set may be a first and a second diode clusters; the first and second diode clusters consist of one or multiple diodes, and that the disposed directions of the first and second diode clusters are opposite.

3. The measure device according to claim 1, wherein the measure resistor of the CCFL set may be Zener diode.

4. The measure device according to claim 1, wherein the two terminals of the measure resistor of the CCFL set parallel connect to the AC terminal of a bridge rectifier; the bridge rectifier's DC positive terminal connects to the limit current resistor and photocoupler LED terminal, then connects to the bridge rectifier's DC negative terminal; the power source supplying to photocoupler LED terminal still comes from the two terminals of the measure resistor.

5. The measure device according to claim 4, wherein the measure resistor of the CCFL set may be a first and a second diode clusters; the first and second diode clusters consist of one or multiple diodes, and that the disposed directions of the first and second diode clusters are opposite.

6. The measure device according to claim 4, wherein the measure resistor of the CCFL set may be a first and a second Zener diodes; and the disposed directions of the first and second Zener diodes are opposite.

7. The measure device according to claim 1, wherein said measure device has two CCFL Clusters sharing a set of up and down limit comparators and within each CCFL Cluster, all lamps are connected at one end to share a measure resistor; the limit current resistor and the photocoupler are serially connected, then parallel coupled with the measure resistor's two terminals, the photocoupler's emitter terminal is joined with a diode, and the diode's N terminal and grounding resistor are connected to the positive and negative terminals of the up, down limit comparators, while the two sets of measure resistor and limit current resistors are interconnected.

8. The measure device according to claim 7, wherein the measure resistor of the CCFL set may be a first and a second diode clusters; the first and second diode clusters consist of one or multiple diodes, and that the disposed directions of the first and the second diode clusters are opposite.

9. The measure device according to claim 7, wherein the measure resistor of the CCFL set may be Zener diode.

10. The measure device according to claim 7, wherein the two terminals of the measure resistor of the CCFL set parallel connect to the AC terminal of a bridge rectifier; the bridge rectifier's DC positive terminal connects to the limit current resistor and photocoupler LED terminal, then connects to the bridge rectifier's DC negative terminal; the power source supplying to photocoupler LED terminal still comes from the two terminals of the measure resistor.

11. The measure device according to claim 10, wherein the measure resistor of the CCFL set may be a first and a second diode clusters; the first and second diode clusters consist of one or multiple diodes, and that the disposed directions of the first and the second diode clusters are opposite.

12. The measure device according to claim 10, wherein the measure resistor of the CCFL set may be a first and a second Zener diodes; and the disposed directions of the first and the second diode clusters are opposite.

13. The measure device according to claim 2, wherein the photocoupler in the protect circuit is parallel connected; the collect-emitter terminal is coupled with negative resistor and diode, then connected to the up and down limit comparators, so that when the up and down limit comparators send out signals, HF power source is cut off.

14. The measure device according to claim 13, wherein the first and second diode clusters of the CCFL set may be replaced by a single diode, and may eliminate HV limit current resistor.

15. The measure device according to claim 4, wherein two CCFL sets share a bridge rectifier; the bridge rectifier's DC terminals are connected to the measure resistor; the bridge rectifier's DC positive terminal connects to the limit current resistor and photocoupler LED terminal, then connects to the bridge rectifier's DC negative terminal; the power source supplying to photocoupler LED terminal still comes from the two terminals of the measure resistor; the protect circuit's photocoupler may be single or multiple.

16. The measure device according to claim 15, wherein the protect circuit's photocoupler is parallel connected, then connects to the up and down limit comparators, so that when the up and down limit comparators send out signals, HF power source is cut off.

17. The measure device according to claim 1, wherein the high frequency power source circuit is full-bridge type electronic ballast.

18. The measure device according to claim 1, wherein the high frequency power source circuit is half-bridge type electronic ballast.

19. The measure device according to claim 1, wherein the protect circuit's up, down limit comparator may be differential amplifier integrated circuit.

20. The measure device according to claim 1, wherein the protect circuit's up, down limit comparator may be digital comparator integrated circuit.

21. A protective device for cold cathode fluorescent lamp (CCFL), said device comprises:

a CCFL Cluster formed by joining multiple CCTL sets through parallel connection, each of said CCFL set comprising HF HV capacitor, cold cathode fluorescent lamp, measure resistor, limit current resistor and photocoupler primary, wherein the HV capacitor, cold cathode fluorescent lamp and measure resistor are serially connected, two terminals of the CCFL set are connected to HF HV terminal, while the two terminals of the measure resistor are coupled in parallel connection with the two terminals formed by serial connection of the limit current resistor and photocoupler LED terminal; and a protection circuit, wherein the photocoupler's two collect-emitter terminals are formed in serial connection to couple with the up and down limit comparators, so that when the up and down limit comparators send out signals, HF power source is cut off.

22. The protective device according to claim 21, wherein the measure resistor of the CCFL set may be a first and a second diode clusters; while the first and second diode clusters may consist of one or multiple diodes, and that the disposed directions of the first and second diode clusters are opposite.

23. The protective device according to claim 21, wherein the CCFL set's measure resistor may be Zener diode.

24. The protective device according to claim 21, wherein the two terminals of the measure resistor of the CCFL set parallel connect to the AC terminal of a bridge rectifier; the bridge rectifier's DC positive terminal connects to the limit current resistor and photocoupler LED terminal, then connects to the bridge rectifier's DC negative terminal; the power source supplying to photocoupler LED terminal still comes from the two terminals of the measure resistor.

25. The protective device according to claim 24, wherein the measure resistor of the CCFL set may be a first and a second diode clusters; while the first and second diode clusters may consist of one or multiple diodes, and that the disposed directions of the first and second diode clusters are opposite.

26. The protective device according to claim 24, wherein the measure resistor of the CCFL set may be a first and a second Zener diodes; and the disposed directions of the first and second Zener diodes are opposite.

27. The protective device according to claim 21, wherein two CCFL sets share a set of up and down limit comparators and within each CCFL Cluster, all lamps are connected at one end to share a measure resistor; the limit current resistor and the photocoupler are serially connected, then parallel coupled with the measure resistor's two terminals, the photocoupler's emitter terminal is joined with a diode, and the diode's N terminal and grounding resistor are connected to the positive and negative terminals of the up, down limit comparators, while the two sets of measure resistor and limit current resistors are interconnected.

28. The protective device according to claim 27, wherein the measure resistor of the CCFL set may be a first and a second diode clusters; while the first and second diode clusters may consist of one or multiple diodes, and that the disposed directions of the first and second diode clusters are opposite.

29. The protective device according to claim 27, wherein the CCFL set's measure resistor may be Zener diode.

30. The protective device according to claim 27, wherein the two terminals of the measure resistor of the CCFL set parallel connect to the AC terminal of a bridge rectifier; the bridge rectifier's DC positive terminal connects to the limit current resistor and photocoupler LED terminal, then connects to the bridge rectifier's DC negative terminal; the power source supplying to photocoupler LED terminal still comes from the two terminals of the measure resistor.

31. The protective device according to claim 30, wherein the measure resistor of the CCFL set may be a first and a second diode clusters; while the first and second diode clusters may consist of one or multiple diodes, and that the disposed directions of the first and second diode clusters are opposite.

32. The protective device according to claim 30, wherein the measure resistor of the CCFL set may be a first and second Zener diodes; and the disposed directions of the first and the second Zener diodes are opposite.

33. The protective device according to claim 21, wherein two CCFL or even numbers of CCFL Clusters share a set of up and down limit comparators; within each CCFL Cluster, all lamps are connected at one end to share a measure resistor; the limit current resistor with variable resistor and the photocoupler LED are serially connected, then parallel coupled with the measure resistor's two terminals, the variable resistor's mid point terminal is coupled with one end of the measure resistor, the photocoupler's emitter terminal is grounded, and the collect-emitter terminal connected to the up and down limit comparators.

34. The protective device according to claim 21, wherein two CCFL or even numbers of CCFL Clusters share a set of up and down limit comparators and within each CCFL Cluster, all lamps are connected at one end to share a measure resistor; the limit current resistor with variable resistor and the photocoupler LED are serially connected, then parallel coupled with the two terminals formed by serial connection of the measure resistor and the variable resistor, the variable resistor's mid point terminal is coupled with the middle of two limit current resistors, the photocoupler's emitter terminal is grounded, and the collect-emitter terminal connected to the up and down limit comparators.

35. The protective device according to claim 22, wherein the protect circuit's photocoupler is parallel connected, the collect-emitter terminal couples with negative resistor and diode, then connects to the up and down limit comparators, so that when the up and down limit comparators send out signals, HF power source is off.

36. The protective device according to claim 35, wherein the first and second diode clusters of the CCFL set may be replaced by a diode, and may eliminate HV limit current resistor.

37. The protective device according to claim 24, wherein two CCFL sets share a bridge rectifier; the bridge rectifier's DC terminals are connected to the measure resistor; the bridge rectifier's DC positive terminal connects to the limit current resistor and photocoupler LED terminal, then connects to the bridge rectifier's DC negative terminal; the power source supplying to photocoupler LED terminal still comes from the two terminals of the measure resistor; the protect circuit's photocoupler may be single or multiple.

38. The protective device according to claim 37, wherein the protect circuit's photocoupler is joined in parallel connection to the up and down limit comparators, so that when the up and down limit comparators send out signals, HF power source is cut off.

39. The measure device according to claim 21, wherein the protect circuit's up, down limit comparator may be differential amplifier integrated circuit.

40. The measure device according to claim 21, wherein the protect circuit's up, down limit comparator may be digital comparator integrated circuit.

* * * * *